US009435286B2

(12) United States Patent
Ramamurthy

(10) Patent No.: US 9,435,286 B2
(45) Date of Patent: Sep. 6, 2016

(54) METHOD TO REDUCE FUEL SYSTEM POWER CONSUMPTION

(71) Applicants: DENSO International America, Inc., Southfield, MI (US); DENSO CORPORATION, Kariya-shi, Aichi-ken (JP)

(72) Inventor: Dhyana Ramamurthy, Novi, MI (US)

(73) Assignees: Denso International America, Inc., Southfield, MI (US); DENSO CORPORATION, Kariya, Aichi-pref. (JP)

( * ) Notice: Subject to any disclaimer, the term of this patent is extended or adjusted under 35 U.S.C. 154(b) by 270 days.

(21) Appl. No.: 14/171,120

(22) Filed: Feb. 3, 2014

(65) Prior Publication Data

US 2015/0219037 A1 Aug. 6, 2015

(51) Int. Cl.
*F02D 41/30* (2006.01)
*F02D 33/00* (2006.01)
(Continued)

(52) U.S. Cl.
CPC ..... *F02D 41/3082* (2013.01); *F02D 41/062* (2013.01); *F02D 41/3854* (2013.01); *F02M 63/005* (2013.01); *F02M 63/028* (2013.01); *F02M 63/0245* (2013.01); *Y10T 137/85986* (2015.04)

(58) Field of Classification Search
CPC ..... F02D 41/3082; F02D 41/3854; F02D 41/3845; F02D 41/062; F02D 41/32; F02D 41/38; F02D 33/00; F02D 33/003; F02D 33/006; F02M 63/0245; F02M 63/005; F02M 63/028; F02M 63/0225; F02M 63/0265; F02M 37/0047; F02M 37/0076; F02M 37/0082; F02M 37/0088; F02M 37/04; F02M 37/08; F02M 37/10; F02M 37/18; Y10T 137/85986
USPC ..... 123/446; 701/103, 104, 105, 113
See application file for complete search history.

(56) References Cited

U.S. PATENT DOCUMENTS 6,325,051 B1 12/2001 Oomori et al.
7,182,067 B2 * 2/2007 Ricco ..... F02D 41/3845 123/300

(Continued)

FOREIGN PATENT DOCUMENTS

JP 2009-221906 10/2009
JP 2013-092077 5/2013

OTHER PUBLICATIONS

Search Report and Written Opinion from corresponding PCT Application No. PCT/US2015/014232 dated May 8, 2015 (9 pages).

*Primary Examiner* — Grant Moubry
(74) *Attorney, Agent, or Firm* — Harness, Dickey & Pierce, P.L.C.

(57) ABSTRACT

A system for delivering fuel to an engine including a fuel reservoir pump configured to pump fuel from a fuel tank to a fuel pump reservoir. A low pressure fuel pump is configured to pump fuel out from within the fuel pump reservoir and to the fuel reservoir pump. A high pressure fuel pump is configured to pump fuel to the engine. The low pressure fuel pump is configured to pump fuel to the high pressure fuel pump. A controller is operable to configure the low pressure fuel pump in a high mode at a first pump rate when the high pressure fuel pump is in a first configuration, and operable to configure the low pressure fuel pump in a low mode at a second pump rate when the high pressure fuel pump is in a second configuration different from the first configuration, the first pump rate is different from the second pump rate.

17 Claims, 3 Drawing Sheets

(51) Int. Cl.

| | |
|---|---|
| ***F02M 63/00*** | (2006.01) |
| ***F02M 37/00*** | (2006.01) |
| ***F02D 41/06*** | (2006.01) |
| ***F02D 41/38*** | (2006.01) |
| *F02M 63/02* | (2006.01) |

(56) References Cited

U.S. PATENT DOCUMENTS 7,201,150 B2 * 4/2007 Oono ..... F02D 41/3845 123/456
7,299,790 B2 * 11/2007 Okamoto ..... F02D 41/3845 123/446
7,318,413 B2 * 1/2008 Iwahashi ..... F02D 41/08 123/431
7,431,018 B2 * 10/2008 Tsujimoto ..... F02D 41/221 123/446
7,493,893 B2 * 2/2009 Funabashi ..... F02D 33/006 123/457
7,588,017 B2 * 9/2009 Briggs ..... F02M 37/025 123/509
7,596,447 B2 * 9/2009 Oono ..... F02D 41/221 123/457
7,856,960 B2 * 12/2010 Serra ..... F02D 41/3854 123/446
7,900,602 B2 * 3/2011 Petrone ..... F02M 37/0029 123/446
8,302,582 B2 * 11/2012 Oohashi ..... F02M 37/0029 123/446
2007/0272217 A1 * 11/2007 Kubota ..... F02M 37/0029 123/457
2008/0173282 A1 7/2008 Briggs et al.
2010/0274467 A1 * 10/2010 Hayami ..... F02D 41/2438 701/103
2011/0146627 A1 6/2011 Oohashi et al.
2012/0073545 A1 * 3/2012 Worthington ..... F02M 37/22 123/497

* cited by examiner

METHOD TO REDUCE FUEL SYSTEM POWER CONSUMPTION

FIELD

The present disclosure relates to a fuel system with reduced power consumption.

BACKGROUND

This section provides background information related to the present disclosure, which is not necessarily prior art.

Systems for delivering fuel to an engine, such as an internal combustion engine, often include a fuel reservoir pump, a low pressure fuel pump, and a high pressure (direct injection) fuel pump. The low pressure fuel pump pumps fuel from a fuel tank to the high pressure fuel pump. The high pressure fuel pump includes a reciprocating plunger, which is driven by a rotating cam (via a follower) having a plurality of lobes. As the cam rotates, it may cycle the high pressure pump through a suction stroke, a pre-stroke (if less than 100% fuel delivery is required), and a pumping stroke. The quantity of fuel that the high pressure pump delivers to the engine is based on engine demand and various engine perimeters, such as mass flow and pressure. Only an amount of fuel required to reach and maintain a commanded fuel pressure in a fuel rail of the fuel system is pumped out of the high pressure pump. When the fuel demand is less than 100% of pump capacity, excess fuel flow, such as during the pre-stroke, is pushed out of the high pressure pump through a pump inlet thereof, and into a low pressure fuel line that delivers fuel to the high pressure pump. Therefore, when engine demand is less than 100% of the high pressure pump's capacity, energy will be wasted operating the low pressure fuel pump to pump fuel to the high pressure pump that is not needed for engine operation.

The low pressure pump is typically operated as part of a Mechanical Returnless Fuel System (MRFS) or an Electronic Returnless Fuel System (ERFS). In a MRFS, a constant voltage is continuously applied to the low pressure fuel pump, which results in the low pressure fuel pump continuously pumping a fixed amount of fuel at a predetermined pressure. With an ERFS, voltage to the low pressure pump is varied depending on operating conditions of the engine in order to vary the quantity of fuel and/or pressure of fuel delivered to the high pressure pump. In both an MRFS and an ERFS, output of the low pressure pump is set to exceed engine demand in order to support continuous operation of the fuel reservoir pump, which pumps fuel from the fuel tank into a fuel pump reservoir in which the low pressure fuel pump is seated to keep the low pressure pump submerged in fuel.

Continuous operation of the fuel reservoir pump and the low pressure fuel pump at levels that exceed engine demand results in inefficiencies, including excess power consumption. A fuel system for delivering fuel to an engine, such as an internal combustion engine, which operates at reduced levels of power consumption and is generally more efficient than existing fuel delivery systems, would therefore be desirable.

SUMMARY

This section provides a general summary of the disclosure, and is not a comprehensive disclosure of its full scope or all of its features.

The present teachings provide for a system for delivering fuel to an engine including a fuel reservoir pump configured to pump fuel from a fuel tank to a fuel pump reservoir. A low pressure fuel pump is configured to pump fuel out from within the fuel pump reservoir and to the fuel reservoir pump. A high pressure fuel pump is configured to pump fuel to the engine. The low pressure fuel pump is configured to pump fuel to the high pressure fuel pump. A controller is operable to configure the low pressure fuel pump in a high mode at a first pump rate when the high pressure fuel pump is in a first configuration, and operable to configure the low pressure fuel pump in a low mode at a second pump rate when the high pressure fuel pump is in a second configuration different from the first configuration, the first pump rate is different from the second pump rate.

The present teachings further provide for a system for delivering fuel to an engine. The system includes a fuel reservoir pump configured to pump fuel from a fuel tank to a fuel pump reservoir. A low pressure fuel pump is configured to pump fuel out from within the fuel pump reservoir and to the fuel reservoir pump. A high pressure fuel pump is configured to pump fuel to the engine. The low pressure fuel pump is configured to pump fuel to the high pressure fuel pump. A controller is configured to operate the fuel reservoir pump in a high mode at a first pump rate when a fuel level of fuel within the fuel tank is below a predetermined threshold, and configured to operate the fuel reservoir pump in a low mode at a second pump rate when the fuel level of fuel within the fuel tank is above the predetermined threshold. The first pump rate is greater than the second pump rate.

The present teachings further provide for a system for delivering fuel to an engine including a fuel reservoir pump configured to pump fuel from a fuel tank to a fuel pump reservoir. A low pressure fuel pump is configured to pump fuel out from within the fuel pump reservoir and to the fuel reservoir pump. A high pressure fuel pump is configured to pump fuel to the engine. The low pressure fuel pump is configured to pump fuel to the high pressure fuel pump. A controller operable to: configure the fuel reservoir pump in a high pumping state when a fuel level of fuel within the fuel tank is below a predetermined level; configure the fuel reservoir pump in a low pumping state when the fuel level of fuel within the fuel tank is above the predetermined level; configure the low pressure fuel pump in a high pump mode at a first pump rate when the high pressure fuel pump is in a first configuration configured to perform a suction stroke; and configure the low pressure fuel pump in a low pump mode at a second pump rate lower than the first pump rate when the high pressure fuel pump is in a second configuration that is not configured to perform the suction stroke.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
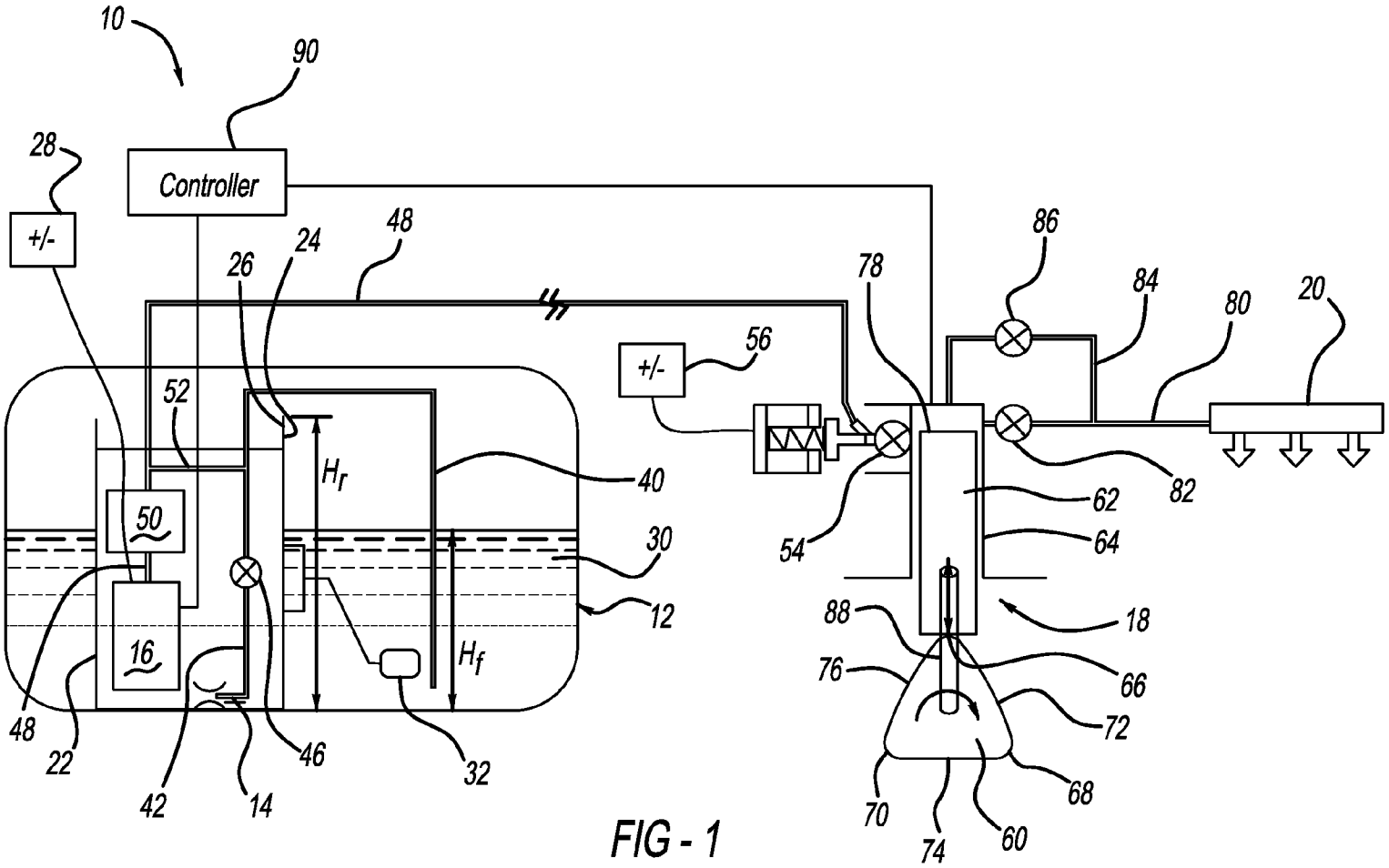
FIG. 1 is a schematic of a fuel system according to the present teachings.

With initial reference to FIG. 1, a fuel system according to the present teachings is illustrated at reference numeral 10. The fuel system 10 generally includes a fuel tank 12, a fuel reservoir pump 14 (which can be a jet pump and is referred to herein as a jet pump), a low pressure fuel pump 16, a high pressure (direct injection) fuel pump 18, and a fuel rail 20 for delivering fuel to a suitable engine (not shown), such as an internal combustion engine. A fuel pump reservoir 22 is seated within the fuel tank 12 and includes a fuel pump reservoir outer wall 24 having a top portion or upper portion 26. The low pressure fuel pump 16 is seated within the fuel pump reservoir 22, and is powered by a low pressure fuel pump power supply 28.

The fuel tank 12 is configured to store fuel 30 therein. The amount of fuel 30 present within the fuel tank 12 can be measured in any suitable manner using any suitable device, such as a fuel level sensor 32. The fuel level sensor 32 measures a height of the fuel level $H_f$ as measured from a bottom or lowermost portion of the fuel tank 12 and relative to a height of the fuel pump reservoir $H_r$.

A reservoir inlet conduit 40 extends into the fuel pump reservoir 22 from a position in the fuel tank 12 sufficient to draw fuel 30 into the fuel pump reservoir 22. The reservoir inlet conduit 40 is connected to a fuel inlet conduit 42, which extends to the jet pump 14. A relief valve/regulator 46 can be included along the fuel inlet conduit 42.

A fuel outlet conduit 48 extends from the low pressure fuel pump 16 through a filter 50, and out of the fuel tank 12 to a valve 54 of the high pressure fuel pump 18, which is remote to the fuel tank 12. The valve 54 can be any suitable valve, such as an electromechanically controlled valve, such as a solenoid valve for example. If the valve 54 is an electromechanically controlled valve, the valve 54 can be powered in any suitable manner, such as by a power supply 56. Within the fuel pump reservoir 22, a return conduit 52 extends from the fuel outlet conduit 48 to generally where the reservoir inlet conduit 40 and the fuel inlet conduit 42 meet. The reservoir inlet conduit 40, the fuel inlet conduit 42, the fuel outlet conduit 48, and the return conduit 52 can each be any suitable conduit, such as a pipe or tube, configured to reliably, efficiently, and safely transport fuel throughout the fuel system 10.

The high pressure fuel pump 18 generally includes a plunger 62 and a plunger housing or chamber 64 in which the plunger 62 is slidably mounted. The plunger 62 is driven by a cam 60 by way of a follower 88 coupled to the cam 60 and the plunger 62. The cam 60 includes any suitable number of lobes, such as two, three (as illustrated), or four, for example.

As illustrated, the cam 60 includes a first lobe 66, a second lobe 68, and a third lobe 70. The first, second, and third lobes 66, 68, and 70 are equally spaced apart from one another, such as spaced apart approximately 120° relative to one another. Regardless of the number of lobes present, the lobes can be equally spaced apart. For example, if four lobes are present, the lobes can be spaced apart 90° relative to one another.

Between the first lobe 66 and the second lobe 68 is a first lobe span surface 72. Between the second lobe 68 and the third lobe 70 is a second lobe span surface 74. Between the third lobe 70 and the first lobe 66 is a third lobe span surface 76. The first, second, and third lobe span surfaces 72, 74, and 76 can each have the same length, or generally similar lengths.

Rotation of the cam 60 results in translational movement of the plunger 62 within the plunger chamber 64. When the plunger 62 is in contact with any one of the first, second, and third lobes 66, 68, or 70 (via the follower mechanism 88), the plunger 62 will be at its highest point within the plunger chamber 64, which is the top dead center position 78 (illustrated in FIG. 1) of the plunger 62. When at the top dead center position 78, the plunger 62 will generally have completed a pumping stroke and be initiating a suction stroke. When the plunger 62 is in contact with the cam 60 along the first, second, or third lobe span surfaces 72, 74, or 76 at a point generally equidistant between the first, second, and third lobes 66, 68, or 70 (via the follower mechanism 88), the plunger 62 will be at its lowest point within the plunger chamber 64, and will generally be between a suction stroke and a pre-stroke of the high pressure fuel pump 18.

The high pressure fuel pump 18 pumps fuel to the fuel rail 20 through fuel rail conduit 80. Along the fuel rail conduit 80 is an outlet valve 82, which regulates passage of fuel from the high pressure fuel pump 18 to the fuel rail 20. Between the outlet valve 82 and the fuel rail 20, a relief conduit 84 extends from the fuel rail conduit 80 to the plunger chamber 64 of the high pressure fuel pump 18. A relief valve 86 is present along the relief conduit 84. The relief conduit 84 allows fuel to flow back to the plunger chamber 64. The relief valve 86 will open when the pressure difference across the relief valve 86 exceeds a predetermined threshold.

Operation of the fuel system 10 is at least partially controlled by controller 90. The controller 90 can be any suitable controller, such as a microprocessor present in any suitable form or device. The controller 90 can be configured to direct or control operation of, for example, the jet pump 14, the low pressure fuel pump 16, and/or the high pressure fuel pump 18.

Figure 2:
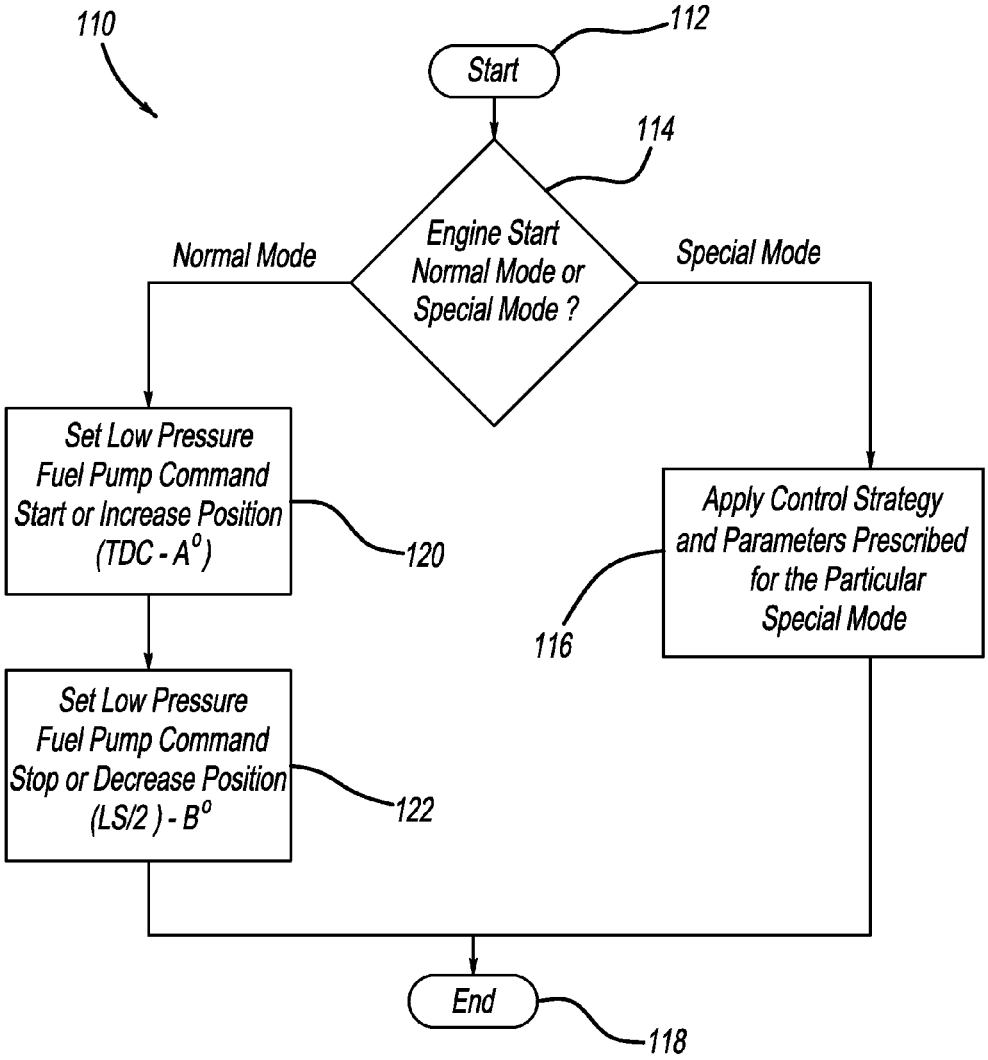
FIG. 2 is a diagram of modes of operation of the fuel system of FIG. 1.

With additional reference to FIG. 2, a mode of operation of the fuel system 10 to be controlled by the controller 90 is generally illustrated at reference numeral 110. The controller 90 initiates operation at start block 112. At block 114, the controller 90 determines whether the fuel system 10 is to be operated under a special mode or a normal mode. The special mode may include various operating modes, such as hot/cold starts, failsafe mode, or diagnostic mode in which full voltage is sent to the pump 16, for example. With reference to block 116, in the special mode a predetermined control strategy and parameters as prescribed for the particular special mode called for are applied to the low pressure fuel pump 16, such as full voltage applied to the pump 16 by the controller 90. The special mode ends at block 118.

If the controller 90 determines that the fuel system 10 is to be operated in normal operating mode, at block 120 the controller 90 sets the low pressure fuel pump 16 to a high mode to start pumping fuel, or increase fuel output if already started, when the cam 60 moves the plunger 62 of the high pressure fuel pump 18 to the top dead center position 78, or slightly before the cam 60 rotates the plunger 62 to the top dead center position 78, such as from about 5 to about 30 (or about 5 to about 10, for example) cam angle degrees (for example depending on speed of rotation of the cam 60 and response time required by low pressure fuel pump 18) prior to reaching the top dead center position 78 (A° as illustrated at block 120). At block 122 the controller 90 sets the low pressure fuel pump 16 to a low mode to stop pumping fuel, or reduce fuel output, when the plunger 62 is in contact with the cam 60 at a halfway point or midpoint of any one of the first, second, or third lobe span surfaces 72, 74, or 76, or at a position of the lobe span surfaces 72, 74, or 76 just prior to the halfway point thereof, such as from about 5 to about 30 or from about 5 to about 10 cam angle degrees (for example depending on speed of rotation of the cam 60 and response time required by low pressure fuel pump 18) prior to the halfway point (B° as illustrated at block 122). After the start and stop positions of the low pressure fuel pump 16 are set at blocks 120 and 122 respectively, the controller 90 proceeds to end block 118.

Therefore, when operating according to the mode of operation 110 the low pressure fuel pump 16 does not continuously run, but rather starts (or increases pumping if already started) when the plunger 62 is at or just prior to the top dead center position 78, which is the point at which the high pressure fuel pump 18 begins its suction stroke. The low pressure fuel pump 16 can be set to stop (or decrease) pumping when the high pressure fuel pump 18 begins its pre-stroke, or just prior to beginning its pre-stroke. The low pressure fuel pump 16 will remain inactive during most or all of the pumping stroke of the high pressure fuel pump 18, or can be set to begin pumping just as the pumping stroke is coming to an end. The mode of operation 110 thus conserves energy by more efficiently operating (such as by not continuously operating) the low pressure fuel pump 16, for example.

Figure 3:
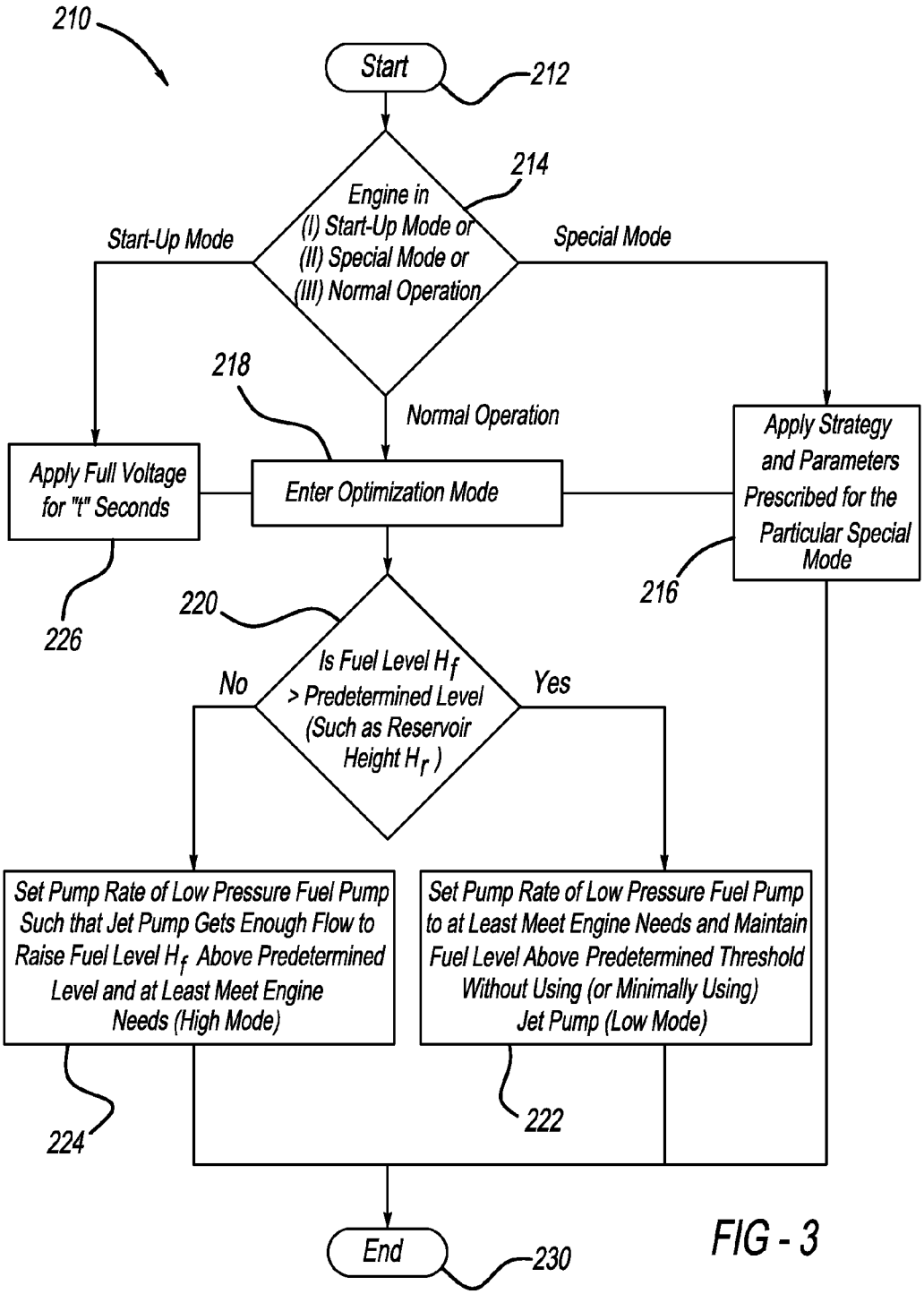
FIG. 3 is a diagram of additional modes of operation of the fuel system of FIG. 1.

With reference to FIG. 3, an additional mode of operation of the fuel system 10 is generally illustrated at reference numeral 210. The mode of operation 210 starts at block 212, and at block 214 the controller 90 determines whether to operate in a special mode, a normal mode, or a startup mode given operating conditions or manual selection. The special mode may include various operating modes, such as hot/cold starts, failsafe mode, or diagnostic mode in which full voltage is sent to the pump 16, for example. In special mode, the controller proceeds to block 216, at which a predetermined control strategy and parameters prescribed for the particular special mode called for will be applied to the low pressure fuel pump 16, such as full voltage applied to the pump 16 by the controller 90. The special mode ends at block 230, or at block 218 of the normal mode where the special mode transitions to the normal mode.

In normal mode, the controller proceeds to block 218, where the controller 90 enters optimization mode and activates the jet pump 14 to pump fuel 30 into the fuel pump reservoir 22 through the reservoir inlet conduit 40. The jet pump 14 can be set to pump fuel 30 for a predetermined period of time based on any suitable known parameters of the jet pump 14 and the fuel pump reservoir 22, in order to fill the fuel pump reservoir 22 such that at least the low pressure fuel pump 16 is submerged in fuel 30.

At block 220, the controller 90 determines whether the height of the fuel level in the fuel pump reservoir 22 is greater than a predetermined level, such as whether the height of the fuel level $H_f$ is greater than or above the top portion or upper portion 26 of the fuel pump reservoir 22, and thus whether the height of the fuel level $H_f$ is greater than the height of the fuel pump reservoir $H_r$. If the height of the fuel level $H_f$ is greater than the predetermined level, at block 222 the controller 90 will set the low pressure fuel pump 16 in a low mode to a level sufficient to at least meet engine needs and maintain the fuel level above the predetermined threshold without using (or minimally using) the jet pump 14. Pump rate of the jet pump 14 is a function of the pump rate of the low pressure fuel pump 16. For example, pump rate of the low pressure fuel pump 16 is equal to, or about equal to, the pump rate of fuel to the engine plus the pump rate of the jet pump 14.

Turning off, or reducing operation of, the jet pump 14 reduces flow output from the low pressure fuel pump 16. Thus, minimizing use of the jet pump 14 to fill the fuel pump reservoir 22 reduces or avoids parasitic loss from the low pressure fuel pump 16, which can reduce energy consumption. In addition to synchronizing the low pressure fuel pump 16 with the cam lobes 66, 68, and 70 and adjusting the low pressure fuel pump 16 output based on the pumping, pre-stroke, and suction strokes, such optimization of operation of the jet pump 14 further conserves power.

From block 222, the controller 90 may proceed to end block 230 or return to block 220 to again assess whether the level of fuel 30 in the fuel tank 12 is above the predetermined level. For example, if the height of the fuel level $H_f$ is not greater than the height of the fuel pump reservoir $H_r$ or some other predetermined level, as sensed by the fuel level sensor 32 for example, then the controller 90 will proceed to block 224. At block 224, the controller 90 sets the pump rate of the low pressure fuel pump 16 in a high mode such that the jet pump 14 gets enough flow to raise the fuel level $H_f$ above the predetermined level and maintain a sufficient amount of fuel in the fuel pump reservoir 22 such that the low pressure fuel pump 16 is at least submerged in fuel 30. The controller 90 will also set the low pressure fuel pump 16 to a level sufficient to at least meet engine needs. In the high mode, the low pressure fuel pump 16 operates at a pump flow rate that is higher than when in the low mode. From block 224, the controller may proceed to end block 230 or return to block 220 to again assess whether the level of fuel 30 in the fuel tank 12 is above the predetermined level.

When the controller 90 is in the start-up mode, the controller 90 proceeds from block 214 to block 226. At block 216, the controller 90 applies full voltage to the low pressure fuel pump 16 for t seconds. The number of seconds t is calculated based on efficiency of the jet pump 14 (such as set forth in a jet pump efficiency curve provided by the manufacturer of the jet pump 14) assuming that a level E of fuel 30 is present in the fuel tank 12. The E level of fuel 30 is equal to a "fuel gage empty" level, which is the most severe condition for the jet pump 14 because at this level pressure head outside of the fuel pump reservoir 22 (to assist filling of the reservoir 22) is minimal. After expiration of t seconds, the controller 90 proceeds to block 218 of the normal operation mode.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A system for delivering fuel to an engine comprising:

a fuel reservoir pump configured to pump fuel from a fuel tank to a fuel pump reservoir;

a low pressure fuel pump configured to pump fuel out from within the fuel pump reservoir and to the fuel reservoir pump;

a high pressure fuel pump configured to pump fuel to the engine, the low pressure fuel pump is configured to pump fuel to the high pressure fuel pump; and a controller operable to configure the low pressure fuel pump in a high mode at a first pump rate when the high pressure fuel pump is in a first configuration, and operable to configure the low pressure fuel pump in a low mode at a second pump rate when the high pressure fuel pump is in a second configuration different from the first configuration, the first pump rate is different from the second pump rate;

wherein the controller is configured to operate the low pressure fuel pump in the low mode when the high pressure fuel pump is performing a pumping stroke.

2. The system of claim 1, wherein the fuel reservoir pump is a jet pump; and wherein the controller operates the low pressure fuel pump at full voltage for a predetermined period of time in a startup mode prior to operating the low pressure fuel pump in a normal operating mode, the predetermined period of time based on an amount of time required to fill the fuel pump reservoir above a predetermined level.

3. The system of claim 1, wherein in the first configuration the high pressure fuel pump is configured to perform a suction stroke.

4. The system of claim 1, wherein in the first configuration the high pressure fuel pump is at a top dead center position.

5. The system of claim 1, wherein in the second configuration the high pressure fuel pump is configured to perform the pumping stroke.

6. The system of claim 5, wherein the controller is configured to start the low pressure fuel pump when the high pressure fuel pump is proximate to an end of the pumping stroke.

7. The system of claim 1, wherein in the high mode the controller is configured to operate the low pressure fuel pump at up to 100% output, and in the low mode the controller is configured to operate the low pressure fuel pump at as low as 0% output.

8. The system of claim 1, wherein in the first configuration the high pressure fuel pump is configured to draw fuel into a plunger chamber of the high pressure fuel pump; and wherein in the second configuration the high pressure fuel pump is configured to pump fuel out from within the plunger chamber of the high pressure fuel pump.

9. The system of claim 1, wherein the high pressure fuel pump includes a plunger, the high pressure fuel pump is in the second configuration when the plunger is aligned with a portion of a cam about equidistant between lobes of the cam.

10. The system of claim 1, wherein the high pressure fuel pump includes a plunger, the controller configures the low pressure fuel pump in the low mode prior to the plunger being aligned with a portion of a cam about equidistant between lobes of the cam.

11. The system of claim 1, wherein the controller is configured to not operate the fuel reservoir pump when a fuel level of fuel in the fuel tank is above a top of the fuel pump reservoir.

12. The system of claim 1, wherein the controller is configured to operate the fuel reservoir pump when a fuel level of fuel in the fuel tank is below a top of the fuel pump reservoir.

13. A system for delivering fuel to an engine comprising:

a fuel reservoir pump configured to pump fuel from a fuel tank to a fuel pump reservoir;

a low pressure fuel pump configured to pump fuel out from within the fuel pump reservoir and to the fuel reservoir pump;

a high pressure fuel pump configured to pump fuel to the engine, the low pressure fuel pump is configured to pump fuel to the high pressure fuel pump; and a controller configured to operate the fuel reservoir pump in a high mode at a first pump rate when a fuel level of fuel within the fuel tank is below a predetermined threshold, and configured to operate the fuel reservoir pump in a low mode at a second pump rate when the fuel level of fuel within the fuel tank is above the predetermined threshold, the first pump rate is greater than the second pump rate;

wherein the controller is configured to operate the low pressure fuel pump in the high mode when the high pressure fuel pump is in a first configuration configured to perform a suction stroke, and configured to operate the low pressure fuel pump in the low mode when the high pressure fuel pump is in a second configuration different from the first configuration.

14. The system of claim 13, wherein the controller is configured to operate the low pressure fuel pump in the high mode when the high pressure fuel pump is performing a pumping stroke.

15. The system of claim 13, wherein in the first configuration the high pressure fuel pump and cam associated therewith are at a top dead center position.

16. A system for delivering fuel to an engine comprising:

a fuel reservoir pump configured to pump fuel from a fuel tank to a fuel pump reservoir;

a low pressure fuel pump configured to pump fuel out from within the fuel pump reservoir and to the fuel reservoir pump;

a high pressure fuel pump configured to pump fuel to the engine, the low pressure fuel pump is configured to pump fuel to the high pressure fuel pump; and a controller operable to:

configure the fuel reservoir pump in a high pumping state when a fuel level of fuel within the fuel tank is below a predetermined level;

configure the fuel reservoir pump in a low pumping state when the fuel level of fuel within the fuel tank is above the predetermined level;

configure the low pressure fuel pump in a high pump mode at a first pump rate when the high pressure fuel pump is in a first configuration configured to perform a suction stroke; and configure the low pressure fuel pump in a low pump mode at a second pump rate lower than the first pump rate when the high pressure fuel pump is in a second configuration that is not configured to perform the suction stroke;

wherein in the first configuration a plunger of the high pressure fuel pump and a cam associated therewith are at or lust prior to a top dead center position; and wherein in the low pumping state the fuel reservoir pump is configured to not pump fuel.

17. A system for delivering fuel to an engine comprising:

a fuel reservoir pump configured to pump fuel from a fuel tank to a fuel pump reservoir;

a low pressure fuel pump configured to pump fuel out from within the fuel pump reservoir and to the fuel reservoir pump;

a high pressure fuel pump configured to pump fuel to the engine, the low pressure fuel pump is configured to pump fuel to the high pressure fuel pump; and a controller operable to configure the low pressure fuel pump in a high mode at a first pump rate when the high pressure fuel pump is in a first configuration, and operable to configure the low pressure fuel pump in a low mode at a second pump rate when the high pressure fuel pump is in a second configuration different from the first configuration, the first pump rate is different from the second pump rate;

wherein in the second configuration the high pressure fuel pump is configured to perform a pre-pumping stroke.

* * * * *